United States Patent [19]

Sikli

[11] 4,175,644

[45] * Nov. 27, 1979

[54] SCISSORS LIFT

[75] Inventor: Bert J. Sikli, Venice, Calif.

[73] Assignee: Robert Staines, Paramount, Calif.

[ * ] Notice: The portion of the term of this patent subsequent to Oct. 5, 1993, has been disclaimed.

[21] Appl. No.: 593,637

[22] Filed: Jul. 7, 1975

Related U.S. Application Data

[63] Continuation-in-part of Ser. No. 542,508, Jan. 20, 1975, Pat. No. 3,983,960, which is a continuation-in-part of Ser. No. 406,260, Oct. 15, 1973, abandoned.

[51] Int. Cl.[2] ..... B66B 11/04; E04G 1/22

[52] U.S. Cl. ..... 187/18; 182/141; 254/122

[58] Field of Search ..... 52/109; 74/521; 108/245; 182/63, 69, 140, 141, 157, 158; 187/1 R, 8.57, 8.71, 8.72, 18; 254/122; D12/54, 56, 57

[56] References Cited

U.S. PATENT DOCUMENTS

| | | | |
|---|---|---|---|
| 3,004,624 | 10/1961 | Green | 182/157 |
| 3,446,379 | 5/1969 | Phillips | 254/122 X |
| 3,672,104 | 6/1972 | Luckey | 182/141 X |
| 3,920,096 | 11/1975 | Fisher | 182/63 |

OTHER PUBLICATIONS

Ballymore Co. Advertisement, Modern Materials Handling, vol. 26, No. 1, Jan., 1971, p. 91.

Ballymore Co. Sales Bulletin S-70R, Ballymore Co., West Chester, Pennsylvania.

*Primary Examiner*—James L. Rowland

*Attorney, Agent, or Firm*—Romney, Schaap, Golant, Disner & Ashen

[57] ABSTRACT

An improved scissors lift which includes a hydraulic mechanism, in the form of one or more hydraulic cylinder/piston units, mounted on scissors linkages in an essentially vertical position in appropriate cradles between two arm pairs of the linkages, at a position in which there is substantial movement at both ends of the hydraulic unit. The cylinder/piston hydraulic unit is so mounted to exert a thrust primarily in the direction of the load for all positions of the linkages, and to provide an essentially constant load/thrust/speed ratio for all positions of the linkages, and also to permit full extension of the linkages without excessive movement of the hydraulic piston. The arms of the scissors linkages are provided with ear-shaped brackets at each end which serve to displace the pivotal axes between the arms away from the horizontal axes of the respective arms so as to permit the arms to be folded down directly on top of one another when the lift is in its collapsed position. This construction not only permits the lift to be collapsed to a minimum height, as compared with the prior art lifts, but it also provides for a minimum stress at the pivot points of the arms when the linkage is in its lowermost position, since the weight of the platform is directly supported by the arms of the linkages along their entire lengths.

19 Claims, 13 Drawing Figures

SCISSORS LIFT

RELATION APPLICATIONS

This application is a continuation-in-part of co-pending application Ser. No. 542,508, filed Jan. 20, 1975, now U.S. Pat. No. 3,983,960 entitled SCISSORS LIFT and which is, in turn, a continuation-in-part application of co-pending application Ser. No. 406,260, filed Oct. 15, 1973 (now abandoned).

BACKGROUND OF THE INVENTION

Scissors lift mechanisms in general are known to the art. The principal purpose of such mechanisms is to provide a safe and efficient means for supporting a working platform at any desired elevation. The scissors lift mechanisms of the prior art are predicated on the well-known "lazy tong" principle, and each comprises a pair of vertically extensible scissors linkages mounted on a frame in laterally spaced, parallel relationship, and a working platform mounted on top of the linkages.

Each of the scissors linkages of the prior art lift mechanisms comprises pairs of arms pivotally connected to one another at their ends and at their centers. The lowermost pairs of arms of the linkages are pivotally mounted at one end to the frame, and they are slidably mounted on the frame at their other ends. An hydraulic drive, or lift, cylinder mechanism is pivotally mounted to the frame in the prior art mechanisms, and it is coupled to a cross-bar extending between the lowermost pairs of arms of the linkages. The hydraulic mechanism serves to turn the arms of the lower most pair about their pivotal axis to extend or retract the linkages and thereby to raise or lower the platform.

The frame is mounted on wheels in most of the prior art lift mechanisms, and an appropriate drive motor is provided to move the lift from one location to another. A control box is usually mounted on the working platform to enable the worker to control the elevation of the platform, and also to move the lift from one location to another, thereby obviating the need for a separate driver.

Each of the scissors linkages of the prior art lift mechanisms comprise pairs of arms pivotally connected to one another at their ends and at their centers. The lowermost pairs of arms of the linkages are pivotally mounted at one end to the frame, and they are slidably mounted on the frame at their other end. It is usual in the prior art scissors lift mechanisms to provide an hydraulic drive cylinder mechanism which is pivotally mounted to the frame, and which is coupleted to a cross-bar extending between the lowermost pairs of arms of the linkages. The hydraulic lift mechanism serves to turn the arms of the lowermost pair about their pivotal axis to extend or retract the linkages and thereby to raise or lower the platform.

A disadvantage in the prior art hydraulic drive is the fact that as the lift mechanism is initially elevated from its lowermost position, the hydraulic cylinder/piston unit of the prior art hydraulic mechanism is positioned almost horizontal, and it must exert an excessively high thrust on the mechanism to turn the lowermost arms and to start the vertical extension of the linkages.

Then, as the prior art lift is extended more and more in a vertical direction, the hydraulic lift unit pivots to an upright position, and it requires less and less thrust to move the load. This results in the need for an excessively large hydraulic lift unit in the prior art scissors lift in order to be effective to move the linkages from their retracted to their fully extended position, and it often leads to the requirement for auxiliary hydraulic lift mechanisms.

In addition to the above, the lift mechanism of the prior art are designed so that the arms do not necessarily open uniformly due to the fact that the arms tend to deflect at unsupported locations thereon. In essence, when examining the pivot points connecting a pair of arms in each of a pair of transversely spaced apart scissors linkages, the pivot points in the spaced apart lowermost arms will have a variable difference with respect to the spacing between the pivot points in the uppermost arms during the initial opening. This problem results from the inelastic instability which is inherent in a beam of the type constituting an arm in a scissors linkage.

There have been many attempts to overcome the problems created by the need for excessively large hydraulic lift units, and to covercome the problems created by the inelastic instability in the scissors lift arms with attempts to employ some form of a somewhat vertically disposed hydraulic lift unit. Thus, one such attempt has been described in the U.S. Pat. No. 3,259,369 to Gridley. However, such prior art attempts have usually resulted in excessive structure in the scissors lift unit in order to support the hydraulic unit.

Moreover, in most constructions, these hydraulic units had at least one end thereof directly connected to the pivot point or to a member which was co-parallel in space with a pivot point connecting two corresponding arms of two transversely spaced apart scissors linkages. This structure tended to create some inherent instability and also required a greater amount of opening force when compared to offsetting the hydraulic drive units from the pivot points.

One of the primary problems of the lift devices of the prior art is that the linkages forming part of the scissors lift were not constructed so that they could be collapsed to a minimum height. Moreover, and by virtue of this fact, the arms in each of the linkages were not supported so as to relieve stress at the pivotal points of the linkage. Thus, the arms alone did not support the total weight of the platform when the linkages were in the collapsed position, and, consequently, a considerable amount of the stress was imposed at the pivotal points connecting the various arms of the linkages. This construction not only resulted in a substantially reduced overall life of the lift mechanism, but also created greater necessity for repairs and maintenance.

There has been at least one attempt to employ brackets at the ends of the arms which serve to offset the pivotal axes of the arms away from their respective longitudinal axes. This construction was designed to permit the linkages to be collapsed in a manner where the arms lie directly upon the next lowermost arm. Nevertheless, this construction, while somewhat effective, really did not provide its maximum utility. One of the principal problems with respect to the brackets which offset the pivotal axes of the arms is that in the prior art lift mechanisms, the hydraulic cylinder units were not essentially located in order to provide vertically extensible thrust and were not necessarily designed to provide uniform load transfer to each of the arms in the scissors lift mechanism. Consequently, in such prior art devices, the principle of offsetting the pivotal axes of the arms did not assume the full advantage of this technique.

There have been several other attempts in the prior art to provide ear-like structures on the ends of the arms forming part of the scissors linkage in order to attempt to create a minimum collapsed condition of the linkages. One such attempt has been described in U.S. Pat. No. 3,672,104 to Luckey. However, in this attempt, as well as in each of these other attempts, the prior art did not recognize that the employment of ears on the ends of the arms forming part of the linkages which offset the pivotal axis of the arms away from their respective longitudinal axis was most effectively important in conjunction with hydraulic lift units which provided an essentially vertical thrust and which thereby permitted the hydraulic unit to create movement from the fully compact position to a fully extended position with a minimum of capacity and in such manner that the thrust exerted thereby was essentially invariable to move the load through all positions of the linkages.

It is, therefore, the primary object of the present invention to provide a lift in which the hydraulic mechanism is capable of performing a desired function with less thrust and more capacity requirement than any prior art mechanism and on a more economical and safer basis and permits the linkages of the lift to be collapsed to a minimum height.

It is another object of the present invention to provide a lift of the type stated which provides uniform load transfer to each of the arms in the scissors lift mechanism forming part of the lift.

It is a further object of the present invention to provide a lift of the type stated which overcomes the inelastic instability which otherwise results in beam deflection in prior art types of lift devices.

It is an additional object of the present invention to provide a scissors lift mechanism of the type stated cooperating with hydraulic power unit and which are capable of being used in a wide variety of devices.

It is another salient object of the present invention to provide a scissors lift of the type stated which permits the linkages to be collapsed to a minimum height by use of ear-shaped brackets at the ends of the arms of the linkages.

With the above and other objects in view, my invention resides in the novel features and form, construction, arrangement and combination of parts presently described and pointed out in the claims.

BRIEF SUMMARY OF THE DISCLOSURE

The improved construction of the present invention includes an hydraulic cylinder/lift unit which is mounted in an essentially fixed angular position such that the load vector is essentially aligned with the vertical axis of the unit, so that the thrust exerted by the unit is essentially in the direction of the load. Moreover, the hydraulic cylinder/lift unit in the mechanism of the present invention is mounted such that the thrust exerted by this unit remains essentially invariable to move the load through all positions of the linkages. This construction results in minimizing the required capacity of the hydraulic lift unit without in any way detracting from the efficiency and safety of the unit, and thus results in a more economical lift which is capable of movement from a fully compact position to a fully extended position in a simple, economical and efficient manner by means of an hydraulic unit having a fraction of the capacity required in the prior art scissors lift. Saddle mechanisms pivotally secure the upper and lower ends of the hydraulic lift unit in such manner that these units remain in essentially vertical positions.

The arms of the scissors linkages of the lift mechanism of the present invention are each provided with a pair of ear-shaped brackets at their ends which serve to off-set the pivotal axes of the arms away from the respective longitudinal axes thereof, and this permits the linkages to be collapsed to a minimum height in which each arm lies directly along the next lowermost arm to relieve the stress at the pivotal points of the linkages, and it also permits the arms to support the total weight of the platform in the collapsed condition of the linkages.

One of the important aspects of the present invention is that the improved construction of the lift unit employs the combination of the hydraulic cylinder/lift unit in the mechanism in such manner that the thrust which is exerted by the hydraulic unit remains essentially invariable to move the load through all positions and in the collapsed condition. Moreover, in this important aspect, the arms are collapsed to a minimum height in which each arm of a linkage lies directly along the next lower-most arm in order to relieve stress at the pivot points of the linkage, and also to permit the arms to support the total weight of the platform in the collapsed condition of the linkages.

BRIEF DESCRIPTION OF THE DRAWINGS

Figure 1:
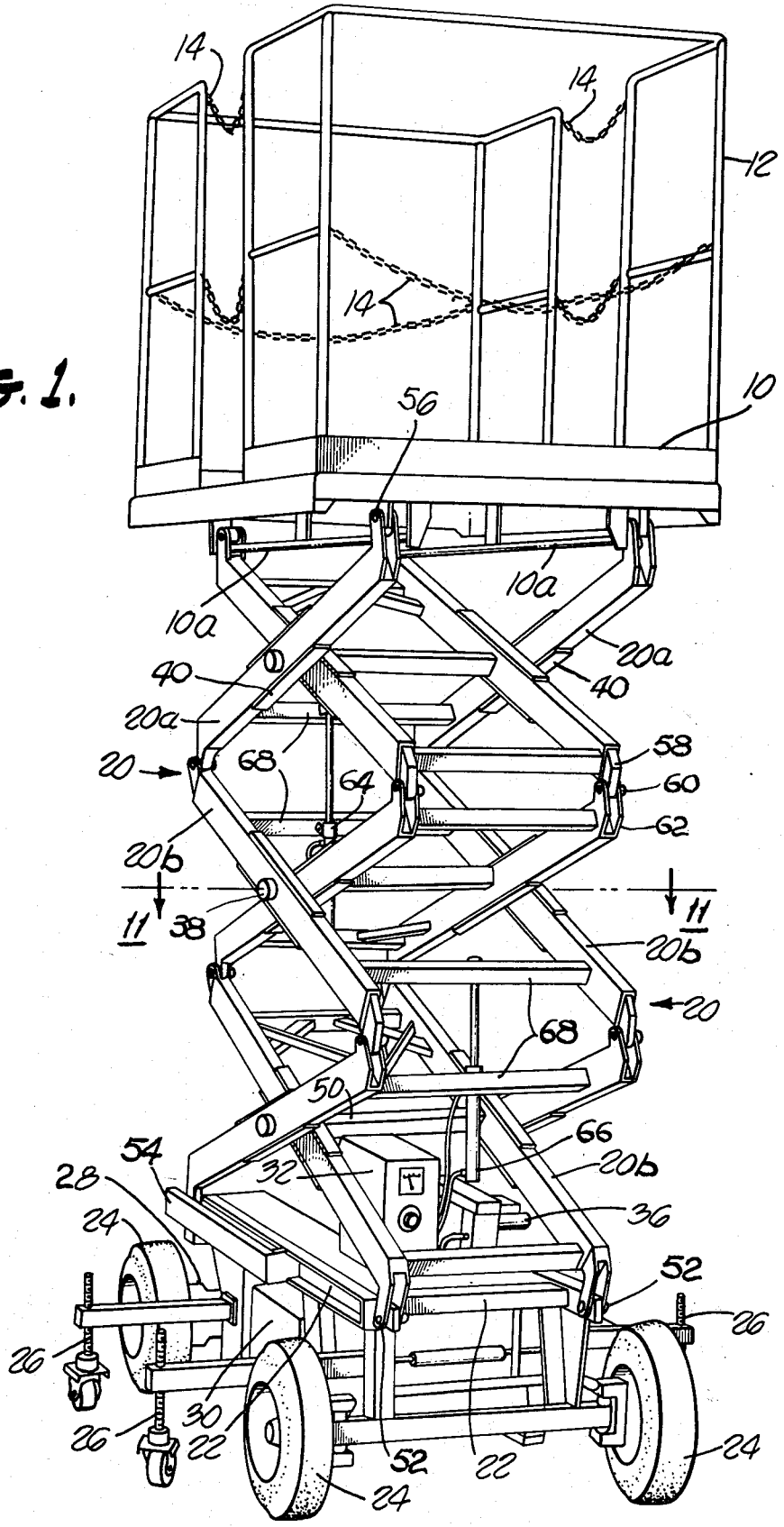
Figure 2:
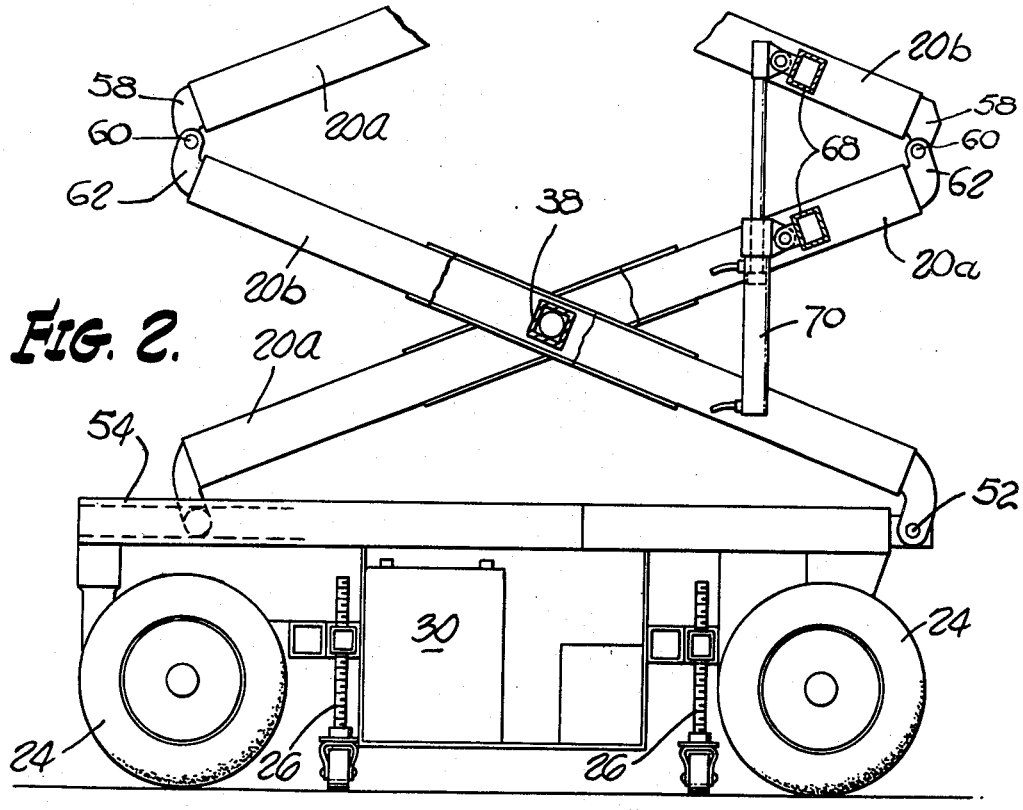
Figure 3:
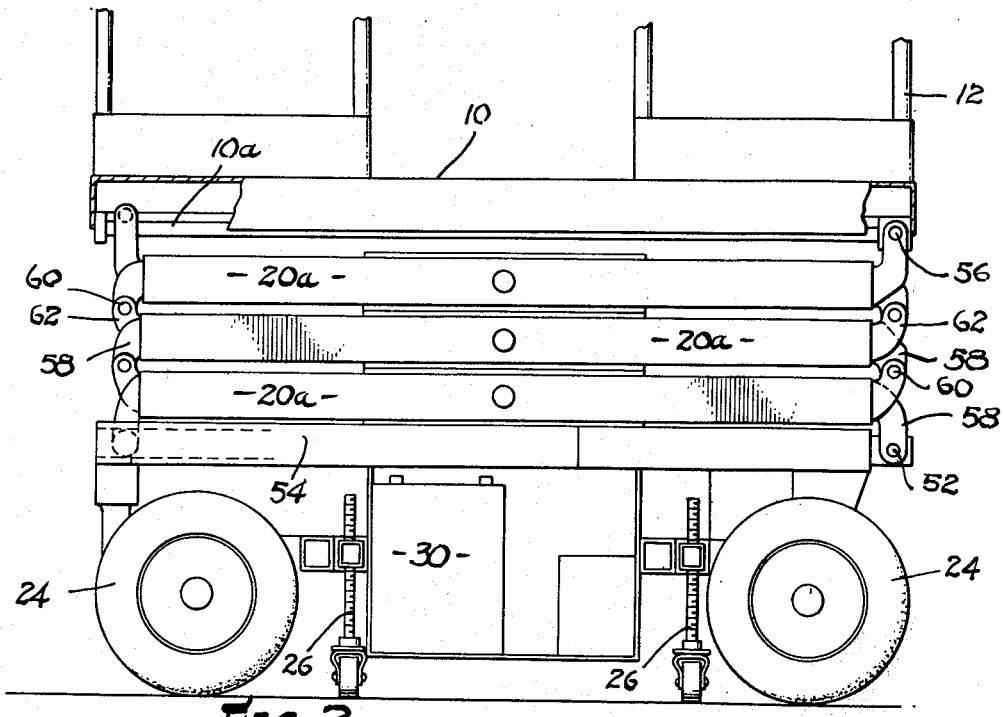
Figure 4:
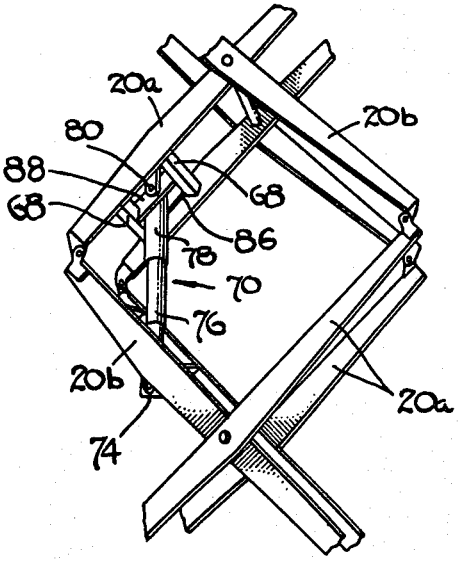
Figure 5:
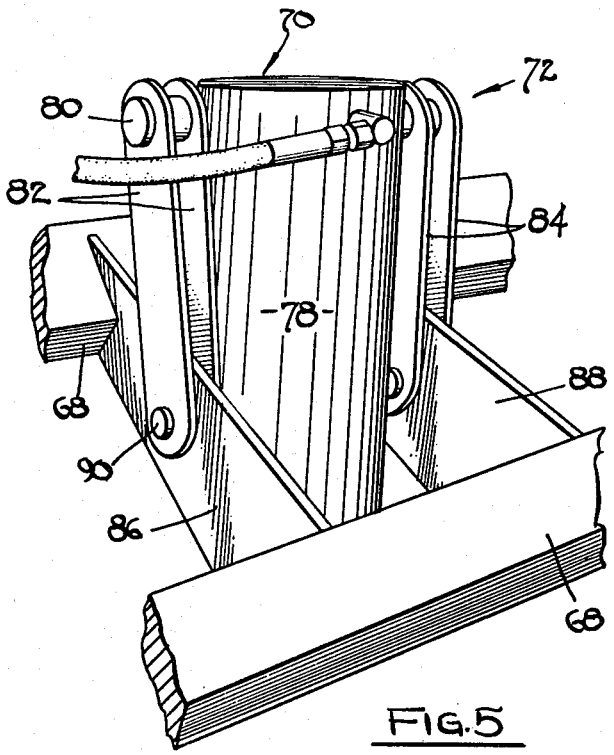
Figure 6:
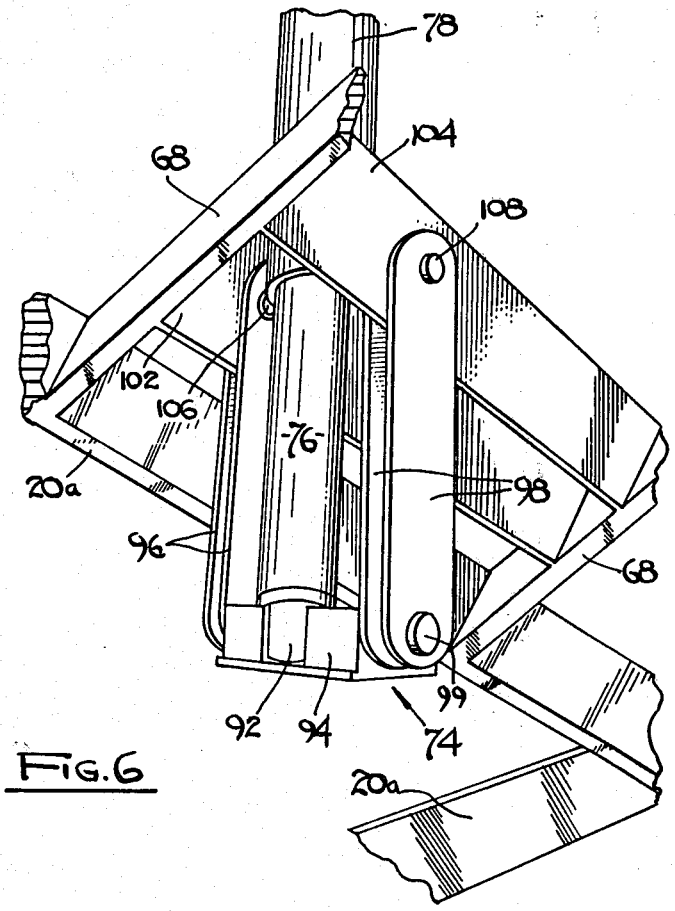
Figure 7:
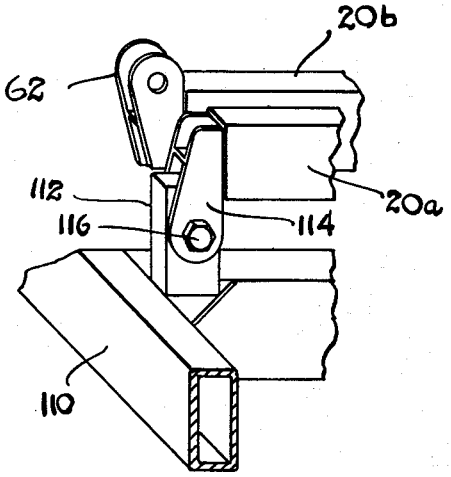
Figure 8:
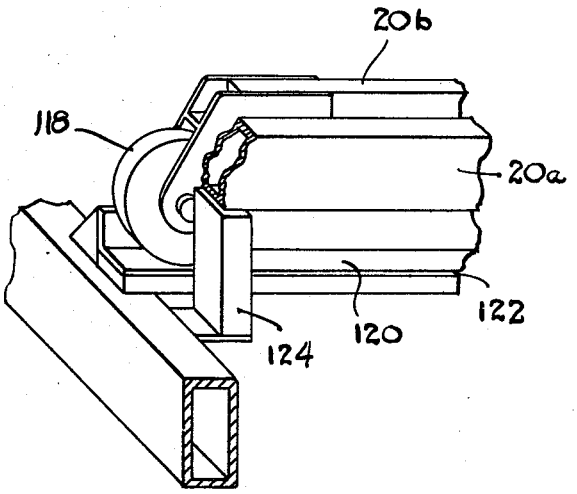
Figure 9:
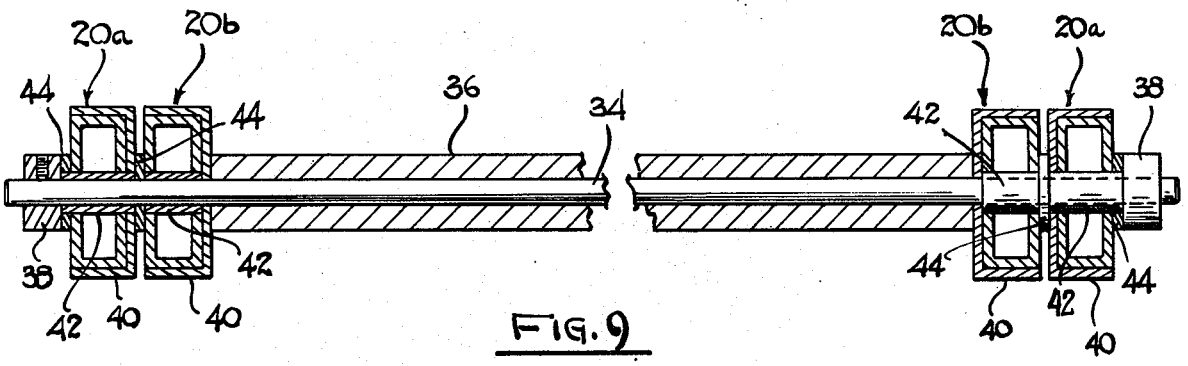
Figure 10:
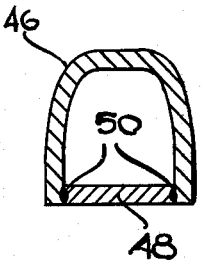
Figure 11:
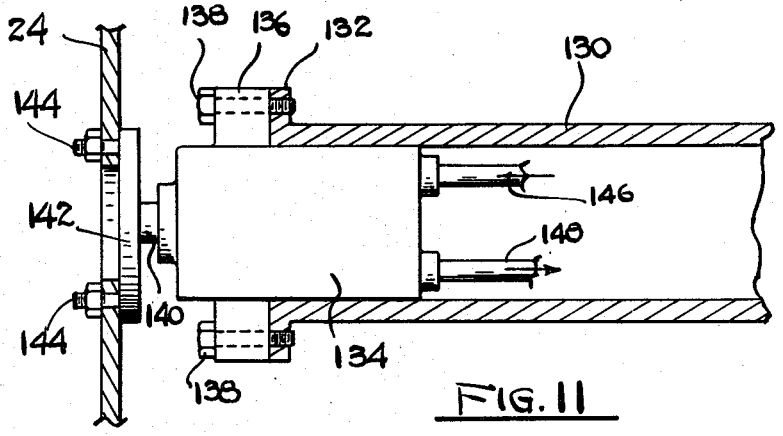
Figure 12:
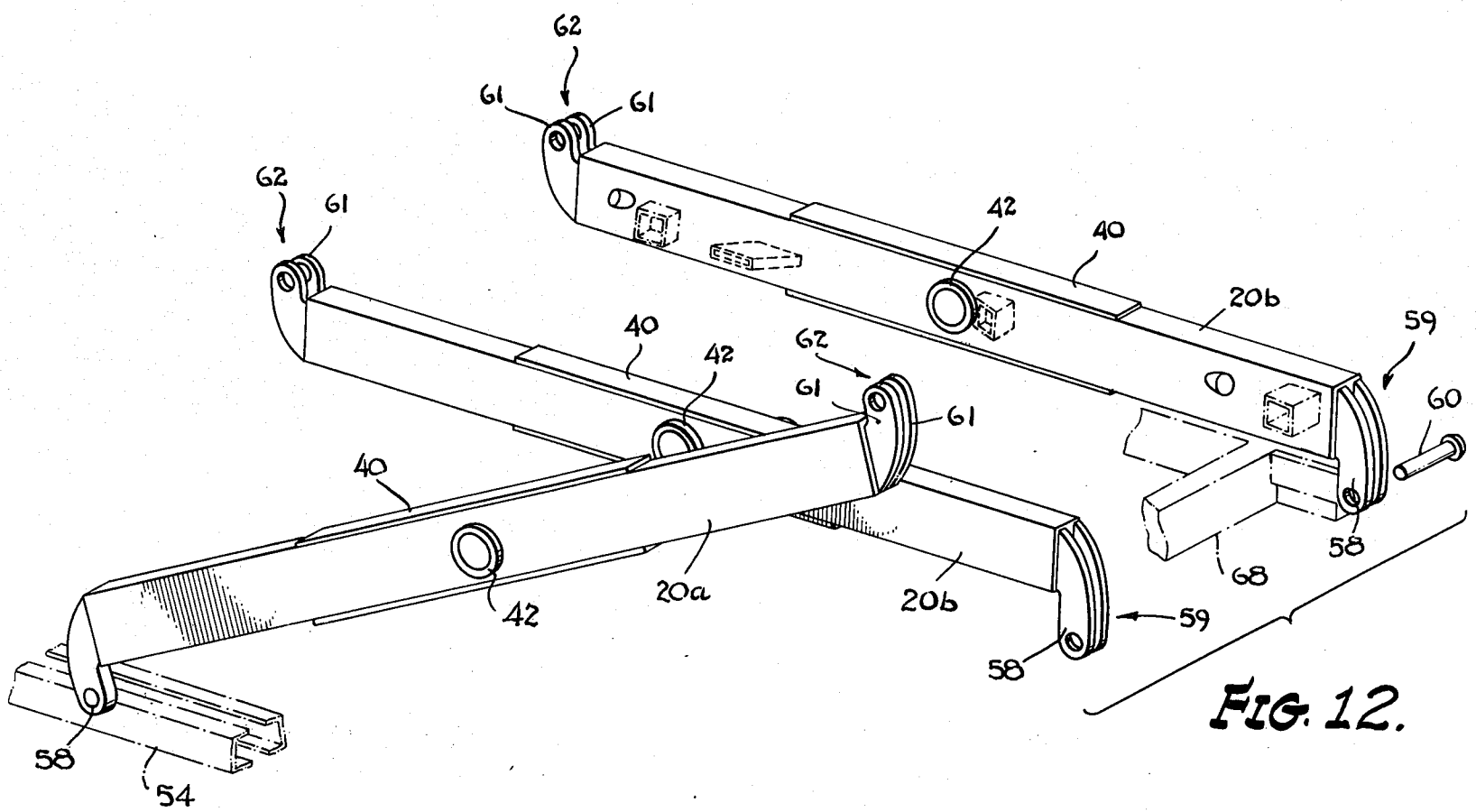
Figure 13:
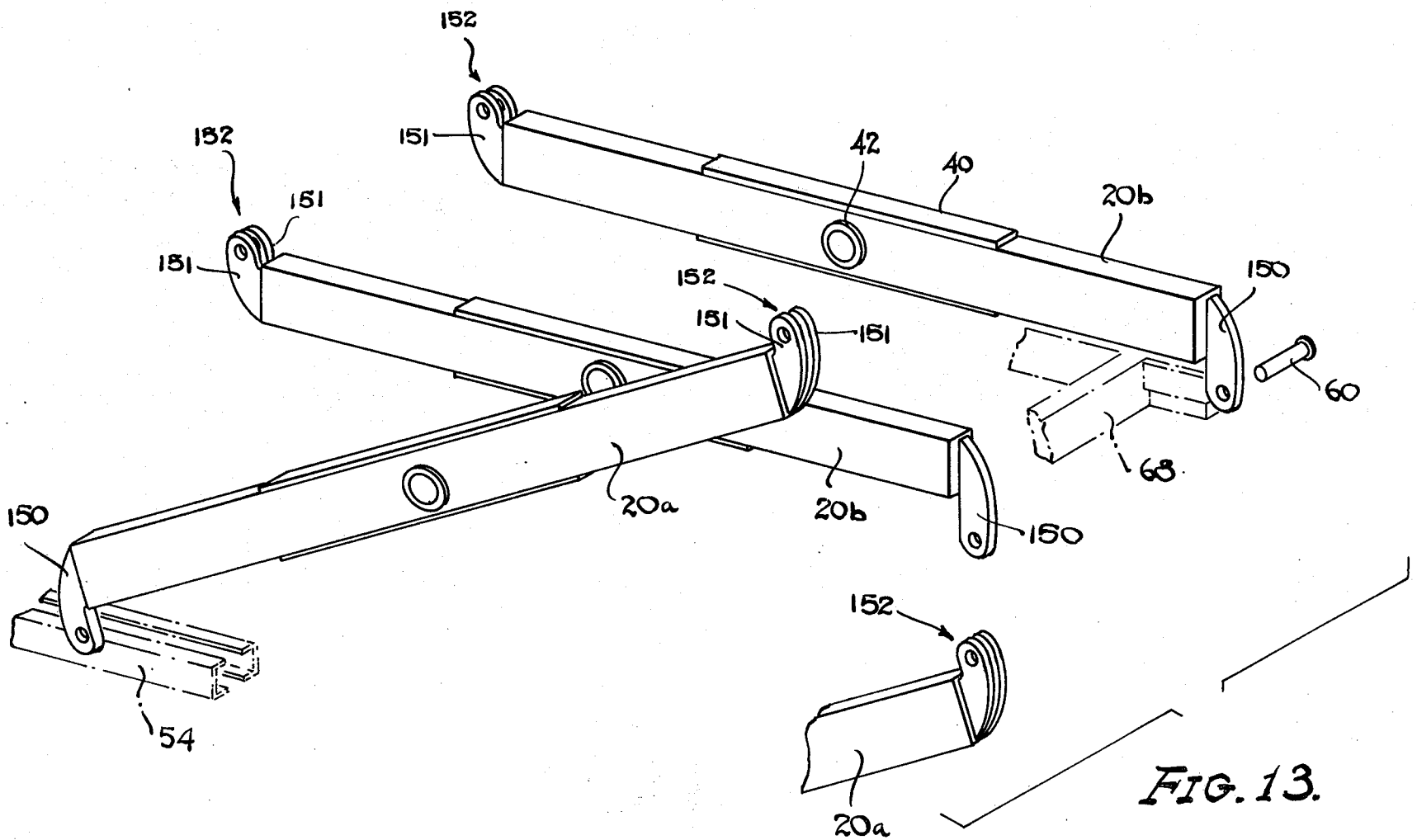

Having thus described the invention in general terms, reference will now be made to the accompanying drawings in which:

FIG. 1 is a perspective representation of a scissors lift which is driven by two hydraulic cylinder lift units, and which is constructed to embody the concepts and principles of the present invention;

FIG. 2 is a partial side elevation of a lift similar to the lift shown in FIG. 1 and showing the linkages thereof in the expanded position;

FIG. 3 is a partial side elevation of a lift similar to FIG. 2 and showing the arms of the scissors lift in the mechanism of FIG. 2 in the collapsed position;

FIG. 4 is a perspective representation of a portion of a scissors lift of the type shown in FIG. 1, and which incorporates upper and lower saddle structures for coupling the hydraulic lift unit to the adjacent arms of the scissors lift;

FIG. 5 is another perspective representation of the upper saddle structure;

FIG. 6 is a further perspective representation of the lower saddle structure;

FIG. 7 is a partial perspective view of an end connection of adjacent arms of the scissors lift;

FIG. 8 is a partial perspective view showing the end connections of adjacent arms of the scissors lift at the opposite ends thereof with respect to FIG. 7;

FIG. 9 is a vertical sectional view taken along line 9—9 of FIG. 1;

FIG. 10 is a vertical sectional view showing one form of arm construction which may be used in the present invention;

FIG. 11 is a vertical sectional view showing one of the drive mechanisms for the wheels used in the lift of the present invention;

FIG. 12 is a perspective representation of the arms used in the linkage of the scissors lift in which the ear structures at the end of the arms are shown in a preferred embodiment of the present invention; and FIG. 13 is a partial perspective representation of one of the arms used in the linkage of the present invention showing a modified form of ear construction.

DETAILED DESCRIPTION OF THE ILLUSTRATED EMBODIMENTS

The lift mechanism shown in FIG. 1 includes a usual working platform 10 surrounded by a guard rail 12 equipped with a safety chain 14. The platform 10 is supported at the upper end of a pair of scissors linkages 20. The scissors linkages are mounted on a wheeled frame 22 which is supported on wheels 24, and which is provided with adjustable outriggers 26. Appropriate heavy duty batteries 30 are supported on the frame, as well as a battery charger 32. Also supported on the frame are a plurality of usual solenoid valves, and a drive motor 28.

The scissors linkages are made up of a plurality of arms designated as 20*a* and 20*b* which are pivotally coupled to one another at their ends and are pivotally connected at their centers by means of pins 34, as shown in FIG. 1. Thus, it can be observed that each of the scissors linkages which are located on opposite longitudinal sides of the platform 10 are comprised of tiers of the various scissors arms and each tier of scissors arms comprises one arm designated as 20*a* and one arm designated as 20*b*.

By reference to FIG. 9, it can be observed that a cross bar 36 extends between each of the pairs of scissors arms 20*a* and 20*b* on each of the transversely spaced apart scissors linkages. It can be observed that in a preferred embodiment of the invention the cross bar 36 is preferably a solid steel member which is internally bored in order to accommodate the pin 34 which may be in the form of an elongate bolt. Moreover, each of the arms 20*a* and 20*b* forming part of the pairs of scissors linkages are retained on the pin or bolt 34 by means of each caps 38, although a bolt head or nut could also be used for this purpose. In this respect, suitable washers and the like could be interposed between the various arms 20*a* and 20*b* and the end caps 38, as well as the cross bar 36.

It can be observed that inasmuch as each of the arms 20*a* and 20*b* are of a rectangular hollow construction, a doubler or so-called reinforcing C-shaped bracket 40 is located on one of the vertically disposed surfaces on each of the arms in the manner as illustrated and is provided with upper and lower struck flanges extending over the upper and lower surfaces of the arms. In addition, and by reference to FIG. 9, it can be observed that a cylindrically shaped retaining sleeve 42 is inserted within a horizontally disposed aperture formed within each of the arms 20*a* and 20*b*. Moreover, a bearing 44 is located on the exterior surface of each of the arms and retained by the end caps 38. In this way, it can be observed that it is possible to use a somewhat thin-walled material in the formation of the arms 20*a* and 20*b* and which are reinforced at the load-bearing points by means of the doublers 40 and the cylindrically shaped retaining sleeves 42.

FIG. 10 illustrates one form of arm construction which may constitute any or all of the arms 20*a* and 20*b*. In this case, it can be observed that the arms 20*a* and 20*b* are comprised of a somewhat C-shaped steel section 46 which has been rotated approximately 90° and is provided with a bottom plate 48 welded to the lower ends of the C-shaped steel section 46 by means of welds 50. It has been found in connection with the present invention that this form of arm construction is preferred, due to the fact that it has been found to be highly capable of resisting bending loads. Nevertheless, in the context of the present invention, arms of rectangular cross-sectional shape and similar shapes could be used in the scissors lift of the present invention.

The lowermost pairs of arms 20*a* are pivoted at one end to the frame 22 by means, for example, of bolts 52, and the lowermost pairs of arms are slidable at the other end of the frame in slots, such as the slot 54. The uppermost pairs of arms 20*a* are pivoted at one end to the underside of the platform 10 by bolts, such as the bolts 56, and the uppermost pairs of arms are slidable at the other end of the platform along bars, such as the bars designated 10*a*.

Each of the arms 20*a* of the scissors linkages is provided with a pair of ear-like brackets at each end. By further reference to FIG. 12 of the drawings, it can be observed that the lower ends of each of the arms 20*b*, when in the expanded position, are provided with a pair of flanges 58 forming a downwardly struck ear-like bracket 59 and the upper ends of each of the arms 20*b* are provided with a pair of spaced apart flanges 61 forming the ear-like brackets 62 at the opposite ends of such arms. The bracket 59 is pivotally connected to the brackets 62 by means of pivot pins 60. In addition, each of the upper ends of the arms 20*a* have the pair of spaced apart flanges 61 forming the ear-like brackets 62 and which are connected to the downwardly struck bracket 59 by means of the pins 60. In like manner, the lower ends of each of the arms 20*a* are provided with the downwardly struck ear-like brackets, such as the bracket 59.

The ear-like brackets may be welded, or otherwise affixed to the ends of the corresponding arms. The ear-like brackets are shaped to displace the pivotal axis at each end of each pair of arms away from the longitudinal axis of the corresponding arms. This assembly permits each pair of arms to fold down directly on top of the arms of the next lower pair when the lift is in its retracted position, so that a minimum height may be achieved when the lift is collapsed, and also to relieve the stresses at the pivotal points.

With respect to the ear-like brackets 59 and 62, it can be observed that the flanges 58 on the ear-like bracket 59 could be spaced apart sufficiently so that the flanges 61 on the ear-like brackets extend inwardly of the flanges 58 in order to receive the pin 60. Nevertheless, the flanges 58 could also extend within the pair of spaced apart flanges 61.

In a preferred embodiment of the present invention, one of the flanges 59 extends in a pair of flanges 61 and the other of the flanges 59 extends outwardly of one of the flanges 61, and in this way have the aligned apertures to receive the pin 60. In each case, it can be observed that the flanges 58 and the flanges 61 are located so that they extend transversely from the longitudinal axis of the respective arms 20*a* and 20*b*.

Moreover, and in a preferred aspect of the invention, the apertures which receive the pivot pin 60 are located so that they are approximately equal to a distance from the longitudinal centerline of the arms which is approximately equal to the overall vertical dimension of the arms. Thus, if the overall dimension of the arms 20*a* and 20*b* were about six inches, the distance between the apertures in the flanges 58 or 61 from a longitudinal centerline passing through the arms 20*a* or 20*b* is also approximately six inches.

In any event, the distance between the longitudinal centerline along the longitudinal axis of the arms 20*a* and 20*b* and the axis of the aperture which receives the pivot pin 60 should be no less than 60 percent of the overall vertical dimension of the arms 20*a* or 20*b*. In like manner, the distance between the longitudinal centerline passing along the longitudinal axis of the arms 20*a* and 20*b* and the apertures which receive the pivot pin 60 should be no greater than 140 percent of the overall vertical dimension of the arms 20*a* or 20*b*.

The scissors linkages are extended to their uppermost position, such as shown in FIG. 1, and retracted to their lowermost position, by means of hydraulic ram means in the form of one or more hydraulic cylinder units mounted on the linkages in a manner to be explained. In the embodiment of FIG. 1, for example, two such hydraulic cylinder/piston lift mechanism designated as 64 and 66 are used. Each of the hydraulic cylinder units in the embodiment of FIG. 1 are mounted on the linkage between corresponding cross-bars 68 extending from one linkage to the other and connected to the adjacent pivoted arms of selected pairs in the linkages. These cross-bars are preferably located closer to the outer ends of each of the arms 20*a* and 20*b*.

The hydraulic cylinder units 64 and 66 in the embodiment of FIG. 1 are essentially vertically mounted in a position for substantial movement at each end of each such unit; and each unit exerts thrusts on the corresponding arms of the linkages at points relatively close to their pivot points, so that maximum extension of the linkages may be achieved without excessive extension of the pistons of the hydraulic unit.

In the embodiment of FIG. 2, a single hydraulic cylinder unit is illustrated, and is coupled to cross-bars extending between adjacent arms of the linkages, as in the previous embodiment. In FIG. 2, the hydraulic cylinder unit 70 may extend at an angle slightly to the vertical.

It has been found in connection with the present invention that one of the important criterion with respect to the lift mechanism is that at least one hydraulic lift unit should be used between each of the vertically disposed pairs of tiers of the linkages. Three tiers of linkages are illustrated in FIG. 1, one of the tiers constituting the lowermost tier, the next upper adjacent tier constituting the central tier and the last tier constituting the uppermost tier. However, it should be understood that any reasonable number of tiers could be used.

Thus, in the case of the present invention, it can be observed that one hydraulic lift unit 66 extends between the arms 20*a* and 20*b* in the lowermost tier to the arms 20*a* and 20*b* in the next adjacent upper tier, namely the central tier. In this case, the piston of the hydraulic cylinder unit 66 is connected to the cross bar 68 of the central tier. In like manner, the hydraulic unit 64 extends between this latter mentioned pairs of arms 20*a* and 20*b* in the central tier such that the piston of this hydraulic lift unit 64 extends to the cross bar 68 in the arms of the third or uppermost tier. In the event that additional tiers of linkages were used, additional cylinder units would also be employed in like manner.

Again, and in connection with the present invention, it has been found desirable to locate one hydraulic cylinder unit, such as the unit 66, on one side of the two vertically disposed tiers with respect to the central pivot, as defined by the pivot pin 34, and the next hydraulic unit, such as the unit 64, on the opposite side of the central pivot, as defined by the pivot pin 34. In the event that a fourth linkage tier of arms were employed, a third hydraulic unit (not shown) would be located in substantially vertical alignment with the hydraulic unit 66. Moreover, the cylinder portion of this unit would be connected to one of the cross bars 68 in the third or uppermost tier of arms, as illustrated in FIG. 1, and the piston portion thereof would be connected to a cross bar 68 in the fourth tier of arms.

In the aforesaid co-pending patent application Ser. No. 542,508, filed Jan. 20, 1975, the force diagram illustrates the relationship of the forces imposed on one of the arms of one of the linkages and the hydraulic cylinder unit is shown as intercoupled between the arms and adjacent the central pivot point of the two arms. The upper platform asserts a downward force P/2 at the ends of the arms and whereas the hydraulic cylinder unit effectively exerts a force P at the intercoupled ends of the arms. The resulting bending moment forces exerted on the arms are represented in the last mentioned application, such that one of the arms is purely in tension.

In the mechanism shown in FIGS. 1 and 2, and described above, the hydraulic units extend essentially in the direction of load, and exert an essentially uniform thrust for all positions of the linkages. This means, as explained above, that the capacity requirements of the hydraulic cylinder units may be minimized, since unlike the prior art mechanisms, there are no excessive load requirements placed on the hydraulic units when the lift mechanism is first elevated from its collapsed position. Also, the positioning of the hydraulic cylinder units adjacent the pivot points of the corresponding arms of the scissors linkages permits the unit to move the scissors lift from its fully retracted to its fully extended position without excessive displacement of the piston in the hydraulic cylinder unit.

In accordance with the above construction, it has been found in connection with the present invention that essentially the entire lift unit may be formed of a mild steel with the exception of the arms in the scissors linkages, and these arms are accordingly made of a high tensile minimum yield steel sheet material. Preferably, the material used in the manufacture of the arms should have a 50,000 psi minimum yield. Nevertheless, the arms can be constructed of a fairly thin gauge material and which are reinforced by the doublers as mentioned above at the points of subjection of load.

It has also been found in connection with the present invention that by using the scissors lift linkage construction as described herein the problems of inelastic instability of the arm which serves as a beam aids in eliminating the typical problem of beam deflection. It can be observed that loads are transmitted from one arm to the other arm at the end pivot points of each of the arms and, moreover, the loads are transmitted through the hydraulic lift units 64 and 66. Consequently, the remaining portions of the beams which form the arms are not subjected to the same tortional or bending moments or forces which thereby permits a much more economical construction of the lift unit.

By utilizing a hydraulic cylinder on every other tier of the scissors linkage, the hydraulic units always extend in essentially vertical position. Moreover, by means of this construction, it is possible to use substantially lower hydraulic pressures for a fixed cylinder and piston area than was attainable in the prior art.

The representations of FIGS. 4, 5 and 6 show upper and lower saddle structures for coupling the hydraulic cylinder unit to the adjacent arms 20*a* of the scissors lift mechanism, so as to permit the hydraulic unit to remain in an essentially vertical position as it drives the arms 20*a* coupled to the upper and lower ends of the hydraulic unit angularly about the axis of their hinges.

In the embodiment of FIGS. 4–6, the hydraulic unit 70 is suspended between the cross bars 68 of the respective arms 20*a* and 20*b* by means of upper and lower saddle structures 72 and 74, respectively. In the illustrated embodiment, the hydraulic unit 70 has two telescoping pistons 76 and a cylinder 78, with the unit 70 being mounted so that the cylinder 78 is at the upper end of the unit, pivotally secured to the upper saddle structure 72. Thus, the pistons 76 extend downwardly and are pivotally secured to the lower saddle structure 74. As shown in FIG. 5, the upper end of the cylinder 78 of the hydraulic unit 70 has a transverse pin 80 extending through it which pivotally mounts the upper ends of two pairs of linkages 82 and 84 on either side of the cylinder 78. The other ends of the linkages 82 and 84 are pivotally coupled to respective brackets 86 and 88 which extend between the adjacent cross bars 68, this being achieved by means of pins, such as the pin 90. These elements constitute the upper saddle structure 72.

By further reference to FIG. 5, it can be observed that each linkage in a pair of such linkages is similarly sized to and retained in spaced apart parallel relation to the other linkage of such pair. Moreover, it can also be observed that the brackets 86 and 88 are generally perpendicular to the cross bars 68 and generally parallel in space to the respective arms 20*a* and 20*b* with which they are associated.

The lower end of the piston 76 of the hydraulic unit 70 is secured to the saddle structure 74 in the manner as illustrated in FIG. 6. The lower end of the piston 76 is provided with an extended flange 92. The lower saddle structure 74 has a transverse member 94 attached to the flange 92, and this transverse member 94 is pivotally coupled to the lower ends of adjacent pairs of linkages 96 and 98 by means of a pin 100. It should be understood that the flange 92 and the transverse member 94 are provided with aligned apertures (not shown) which accommodate the pin 100, and in this way the piston 76 is attached to the transverse member 94. The upper ends of the linkages 96 and 98 are respectively coupled to brackets 102 and 104 by pins 106 and 108, respectively, and the brackets 102 and 104 are secured to the opposed cross bars 68. These latter elements constitute the lower saddle structure 74.

By further reference to FIG. 6, it can also be observed that each linkage in a pair of the linkages 96 and 98 is similarly sized to and retained in spaced apart parallel relation to the other linkage of such pair. In like manner, the brackets 102 and 104 are generally perpendicular to the cross bars 68 and are generally parallel in space to the arms 20*a* and 20*b*. The linkage arms 20*a* are also illustrated in FIG. 6 in order to show the perpendicular relationship between the cross bars 21 and the parallel relationship to the arms 20*a*.

The upper and lower saddle structures described above serve to maintain the hydraulic cylinder unit 70 in an essentially vertical position, as it moves the upper and lower adjacent arms 20*a* and 20*b* angularly to raise and lower the scissors lift mechanism. These saddle structures permit the lift to be completely retracted so that the adjacent arms 20*a* or 20*b* lie across one another when the platform is in its lowermost position, and then to be fully extended, with the hydraulic unit 70 being maintained in its vertical position at all times, so as to exert maximum force on the adjacent arms.

The resulting mechanism constructed in accordance with the invention is relatively simple and economical in its construction, and yet it is capable of performing all the functions of the equivalent complex prior art mechanisms at all load levels, and on a simpler, more economical and safer basis.

With respect to the saddle structures described above, it can be observed that the linkages 82 and 84 are formed of steel straps and generally should have fairly close alignment. Otherwise, if the straps were not aligned, a cocking of the cylinder and a bending of the straps would result. Consequently, one set of arms would receive the load and upset the entire balance of the various two adjacent pairs of linkages. In this same respect, it can be observed that the loads are transferred from one arm in a linkage to another arm in another linkage with fairly uniform load transfer occurring both through the hydraulic lift mechanisms and through the ear-shaped brackets at the ends thereof.

The transverse member 94 which functions as a saddle block actually performs three major functions. The first of these functions is to maintain loading of the associated cylinder and not permitting the cylinders to slide from one side to the other in a transverse direction. In addition, this saddle block 94 maintains centering of the pin 100. Moreover, and more importantly, the saddle block 94 holds the pin 100 in a sheared condition rather than a bending moment condition.

FIGS. 7 and 8 illustrate an embodiment of mounting the lowermost arms of the lowermost tiers of scissors linkages to the frame. In this case, reference numeral 110 designates the base frame. An upstanding pivot block 112 is welded or otherwise secured to the upper surface of the frame 110. Pivotally secured to the pivot block 112 is an ear 114 corresponding to an ear 58 which is pivotally secured to the pivot block 112 by means of a pivot pin 116. This ear is welded or otherwise rigidly secured to one of the arms 20*a*. The next adjacent arm forming part of the scissors linkage, namely the arm 20*b*, which is pivoted to the last mentioned arm 20*a* at a centerpoint, is also pivoted at the same corresponding end at the pivot block 112 through the ears 58 and 62 to another arm 20*a* (not shown). In this case, it can be observed that the innermost arms 20*a* and 20*b* are spaced upwardly from the frame 110 when in the nested condition.

By referring to FIG. 8, it can be observed that the opposite end of the last mentioned arm 20*b* is provided with a roller 118 which rides within a trackway 120 essentially formed by an L-shaped beam 122. Again, the outermost first mentioned arm 20*a* is pivoted to another arm 20*b* (not shown) and is supported on an upstanding support post 124.

FIG. 11 illustrates a modified form of construction for driving the various wheels 24. In this case, a hollow tubular shaft 130 extends between opposed wheels on opposite transverse sides of the base frame 22. The tubular shaft 130 is provided with an annular outwardly struck peripheral flange 132 at each transverse end thereof. Inserted within the open end of the shaft 130 at each of the ends is a hydraulic motor 134 which is constructed with an annular hub 136 which abuts against the flanges 132. In this case, the hub 136 could be bolted to the flange 132 by means of bolts 138.

The motor 134 is provided with a drive shaft 140 which serves as an axle and is provided with a mounting plate 142. In this case, the mounting plate 142 is bolted or otherwise secured to the wheel 24 through studs 144. Moreover, it can be observed that the hydraulic motor 134 is supplied with a hydraulic driving fluid through inlet and outlet tubes 146 and 148, respectively. In this respect, the inlet and outlet tubes 146 and 148 would be connected to a suitable source of hydraulic fluid under pressure including a reservoir and a pump.

FIG. 13 represents a further modified form of end connection which may be used in accordance with the present invention. In this case, each of the arms 20*a* are provided at their lower end with a single downwardly depending ear-like bracket in the form of a single flange 150. Nevertheless, the arms 20*a* at their upper ends, when in the extended position, are provided with a pair of flanges 151 to form the ear-like brackets 152 corresponding to the ear-like brackets 58. Each of the opposite ends of the arms 20*b* are similarly formed of a single flange which forms the ear-like bracket and which is received within the pair of spaced apart flanges 151 which form the ear-like brackets 152.

Thus, there has been illustrated and described a unique and novel lift unit which can be made in a variety of sizes and shapes, and used in a wide variety of applications and which therefore fulfills all of the objects and advantages sought therefor. Many changes, modifications, variations and other uses and applications of the subject lift unit and the components thereof will become apparent to those skilled in the art after considering this specification and the accompanying drawings. All such changes, modifications, variations and other uses and applications which do not depart from the spirit and scope of the invention are deemed to be covered by the invention which is limited only by the following claims.

Having thus described my invention, what I desire to claim and secure by Letters Patent is:

1. A load lifting scissors lift assembly comprising a lower supporting frame, a plurality of vertically extensible scissors linkages mounted on said frame in a tiered relationship, a platform supported at the upper end of the uppermost of said linkages, each of said linkages including two spaced and parallel pairs of arms having longitudinal centerlines passing through the longitudinal axis of each of said arms and being equidistant between upper and lower surfaces on each of said arms, said plurality of scissors linkages including at least a first lower scissors linkage and a next adjacent second scissors linkage spaced upwardly from said first linkage, the arms of each pair in a linkage being pivotally connected at a point intermediate the ends thereof, coupling means at the ends of the arms of each pair for pivotally connecting the arms at their ends to the arms of the adjacent pairs, said coupling means including an ear-shaped bracket member mounted at each end of the arms of said linkages to displace the pivot axis of the adjacent pairs of arms away from the longitudinal axis of the respective arms to permit the linkages to be collapsed to a position in which the arms of each pair engages the arms of the next lowermost pair, each of said ear-shaped bracket members having an aperture located beyond the upper and lower surfaces of the associated arm, the apertures in two such bracket members forming an aligned coupling means such that the apertures are substantially equidistantly spaced from the centerlines of the arms in the brackets mounted to said arms, a pivot element located in the aligned apertures of such two brackets members and generally being spaced outwardly from the upper and lower surfaces of the arms to which said bracket members are attached and being substantially equidistantly spaced from the centerlines of the two arms which are so pivotally coupled, the first pair of arms of the first lower linkage being pivotally mounted through said ear-shaped bracket members at one end to the frame, and a second pair of arms of said first lower linkage being slidably coupled to the other end of the frame, a transverse bar extending between one of the pairs of arms of each of the first lower pairs of linkages at a point intermediate the ends of said arms, a second transverse bar extending between one of the pairs of arms of each of the second pairs of linkages at a point intermediate the ends of said arms, an essentially vertically positioned extensible drive unit, first connecting means for connecting said drive unit to said first transverse bar, second connecting means for connecting said drive unit to said second transverse bar, said drive unit being pivotally coupled to said first transverse bar and coupled to said second transverse bar for turning said first pair of arms of the lowermost linkage about their pivotal axis to extend and retract the linkage and thereby to raise and lower the platform, and the first and second transverse members being essentially vertically movable in opposite directions as the lift assembly raises and lowers the upper platform.

2. The load lifting scissors lift assembly defined in claim 1, in which said first transverse member is connected to a point on said arms of said first linkage between the center and one end thereof, and in which the second transverse member is connected to a point on the arms of said second linkage between the center and one end thereof.

3. The load lifting scissors lift assembly of claim 1 further characterized in that said coupling means comprises a pair of spaced apart flanges forming the ear-like brackets on one end of each of said arms and a pair of spaced apart flanges forming the ear-like bracket on the other end of each of said arms.

4. The load lifting scissors lift assembly of claim 1 further characterized in that said coupling means comprises a pair of spaced apart flanges forming the ear-like brackets on one end of each of said arms and a single flange forming the ear-like bracket on the other end of each of said arms and an ear-like bracket of a single flange being pivotally connected to an ear-like bracket of a pair of spaced apart flanges through a pivot pin.

5. The load lifting scissors lift assembly of claim 1 further characterized in that said ear-like brackets are provided with apertures for receivng pivot pins, and said apertures being spaced from said longitudinal centerline passing through said arms by a distance approximately equal to the overall vertical dimension of one of the arm.

6. The load lifting scissors lift assembly of claim 1 further characterized in that said ear-like brackets are provided with apertures for receiving pivot pins, and said apertures being spaced from said longitudinal centerline passing through said arms by a distance no greater than 140% and no less than 60% of the overall vertical dimension of one of the arms.

7. A load lifting scissors lift assembly comprising a lower frame, an upper platform, a lower tier and a next adjacent upper tier of vertically-extensible parallel scissors-type linkages interposed between said lower frame and said upper platform, each of the linkages in said tiers being comprised of a first lever arm and a second lever arm which form the linkages of each tier, and each of said arms having longitudinal centerlines passing through the longitudinal axis of each of said arms and being equidistant between upper and lower surfaces on each of said arms, coupling means for pivotally coupling the end of a first arm of a lower tier to the associated end of a second arm of the next upper tier, said coupling means comprising an upwardly located first ear-shaped bracket member mounted at the end of the first arm of the lower tier, said coupling means also comprising a downwardly located second ear-shaped bracket member mounted at the end of the second arm of the next upper tier, said first bracket member having an aperture located above the upper surface of said first arm to which said bracket is mounted, said second bracket member having an aperture alignable with the aperture in said first bracket and being located below the lower surface of said second arm to which said bracket is mounted such that the apertures are substantially equidistantly spaced from the centerlines of the arms in the brackets mounted to said arms, a pivot pin located in said aligned apertures and being located above the lower surface of said last-named second arm and above the upper surface of said last-named first arm and being substantially equidistantly spaced from the centerlines of the two arms which are so pivotally coupled to displace the pivot axis of the adjacent pairs of arms away from the longitudinal axis of the respective arms to permit the linkages to be collapsed to a position in which the arms of each pair lie in juxtaposed relationship to the arms of the next lowermost pair, an essentially vertically positioned extensible drive unit, at least one first transverse cross-bar connected to the first arms of each of said tiers of said linkages, at least one second transverse cross-bar connected to second arms of each of said tiers of said linkages, first connection means pivotally connecting a first cross-bar of one of said tiers to said drive unit, and second connection means pivotally connecting a second cross-bar of another of said tiers to said drive unit.

8. The load lifting scissors lift assembly of claim 7 further characterized in that said coupling means comprises a pair of spaced apart flanges forming the ear-like brackets on one end of each of said arms and a pair of spaced apart flanges forming the ear-like bracket on the other end of each of said arms.

9. The load lifting scissors lift assembly of claim 7 further characterized in that said coupling means comprises a pair of spaced apart flanges forming the ear-like brackets on one end of each of said arms and a single flange forming the ear-like bracket on the other end of each of said arms and an ear-like bracket of a single flange being pivotally connected to an ear-like bracket of a pair of spaced apart flanges through a pivot pin.

10. The load lifting scissors lift assembly of claim 7 further characterized in that said ear-like brackets are provided with apertures for receiving pivot pins, and said apertures being spaced from said longitudinal centerline passing through said arms by a distance approximately equal to the overall vertical dimension of one of the arms.

11. The load lifting scissors lift assembly of claim 7 further characterized in that said ear-like brackets are provided with apertures for receiving pivot pins, and said apertures being spaced from said longitudinal centerline passing through said arms by a distance no greater than 140% and no less than 60% of the overall vertical dimension of one of the arms.

12. A load lifting scissors lift assembly comprising a lower frame, an upper platform, a lower tier and a next adjacent upper tier of pairs of laterally-spaced vertically-extensible parallel scissors-type linkages interposed between said lower frame and said upper platform, each of the linkages in said tiers being comprised of a pair of laterally spaced first lever arms and a pair of laterally spaced second lever arms which form the pairs of linkages of each tier, each of said arms having longitudinal centerlines passing through the longitudinal axis of each of said arms and being equidistant between upper and lower surfaces on each of said arms, coupling means for pivotally coupling the ends of the first arms of a lower tier to the next upper tier, said coupling means comprising an upwardly located first ear-shaped bracket member mounted at the ends of the first arms of the lower tier, said coupling means also comprising a downwardly located second ear-shaped bracket member mounted at the ends of the second arms of the next upper tier, each of said first bracket member having an aperture located above the upper surface of said first arms to which said brackets are mounted, each said second bracket member having an aperture alignable with the aperture in said first bracket and being located below the lower surfaces of said second arms to which said brackets are mounted such that the apertures are substantially equidistantly spaced from the centerlines of the arms in the brackets mounted to said arms, a pivot pin located in said aligned apertures and being located above the lower surface of said last-named second arms and above the upper surface of said last-named first arms and being substantially equidistantly spaced from the centerlines of the two arms which are so pivotally coupled to displace the pivot axis of the adjacent pairs of arms away from the longitudinal axis of the respective arms to permit the linkages to be collapsed to a position in which the arms of each pair lie in juxtaposed relationship to the arms of the next lowermost pair, said apertures being spaced from a longitudinal centerline passing through said arms by a distance approximately equal to the overall vertical dimension of one of the arms, an essentially vertically positioned extensible drive unit, at least one first transverse cross-bar connected to the first pair of arms of each of said tiers of said linkages, at least one second transverse cross-bar connected to the second pair of arms of each of said tiers of said linkages, first connection means pivotally connecting a first cross-bar of one of said tiers to said drive unit, and second connection means pivotally connecting a second cross-bar of another of said tiers to said drive unit.

13. The load lifting scissors lift assembly of claim 12 further characterized in that said ear-like brackets are provided with apertures for receiving pivot pins, and said apertures being spaced from said longitudinal centerline passing through said arms by a distance no greater than 140% and no less than 60% of the overall vertical dimension of one of the arms.

14. A load lifting scissors lift assembly comprising a base frame, an upper platform, first and second pairs of crossed lever arms forming a pair of laterally spaced, vertically-extensible, parallel scissor-type linkages interposed between said base frame and said upper platform, said lever arms of said linkages being operatively coupled to said base frame and said platform to enable vertical shiftable movement of said platform relative to said base frame, connecting means for pivotally connecting the lever arms of each of said linkages to one another at their said ends, said connecting means comprising an ear-shaped bracket member mounted at each end of each of the arms of said linkages to displace one of the end pivot axes of the corresponding arm away from the longitudinal axis thereof in a first direction, and to displace the other of the end pivot axes of the corresponding arm away from the longitudinal axis thereof in the opposite direction, so as to permit the linkages to be collapsed to a position in which the arms of each pair engage the arms of the next lowermost pair, an extensible drive unit, a first pair of transverse members extending between each arm of said first pair of lever arms and a second pair of transverse members extending between each arm of said second pair of lever arms, a first saddle structure pivotally connected to said drive unit and also being operatively pivotally connected to said first pair of transverse members, and a second saddle structure pivotally connected to said drive unit at a point spaced from the connection between said drive unit and first pair of transverse members and said second saddle structure also being operatively pivotally connected to the second pair of said transverse members, said first and second saddle structures being located relative to said crossed lever arms such that said drive unit is permitted to remain in substantially the same vertical position in space relative to movement of said lever arms during their vertically extensible movement.

15. The load lifting scissors lift assembly defined in claim 14 and in which said extensible drive unit is an essentially vertically positioned extensible hydraulic drive unit.

16. The load lifting scissors lift assembly defined in claim 14 and in which said first pair of spaced apart and parallel cross-bars extend between said first pair of lever arms of said linkages, and a first pair of spaced and parallel longitudinal brackets extend between the cross-bars of said first pair of cross-bars, and the first of said saddle structures is pivotally secured to said first pair of longitudinal brackets.

17. The load lifting scissors lift assembly defined in claim 16 and in which said second pair of spaced apart and parallel cross-bars extend between said second pair of lever arms of said linkages, and a second pair of spaced and parallel longitudinal brackets extend between the cross-bars of said second pair of cross-bars, and the second of said saddle structures is pivotally secured to the second pair of longitudinal brackets.

18. The load lifting scissors lift assembly defined in claim 14, and wherein said first saddle structure comprises a plurality of first linkage arms, each of said linkage arms having one end pivotally coupled to one end of said drive unit and each of said first linkage arms having their other ends pivotally coupled to the longitudinal brackets of the first pair of longitudinal brackets.

19. The load lifting scissors lift assembly defined in claim 18, and wherein said second saddle structure comprises a plurality of second linkage arms, each of said second linkage arms having one end pivotally coupled to another other end of said drive unit, and each of said second linkage arms having their other ends pivotally coupled to the longitudinal brackets of the first pair of longitudinal brackets.

* * * * *